US005601782A

United States Patent [19]

Kunioka et al.

[11] Patent Number: 5,601,782

[45] Date of Patent: Feb. 11, 1997

[54] ABRASIVE RESISTANT HIGH MANGANESE CAST STEEL

[75] Inventors: Saburo Kunioka, Kawagoe; Hiroshi Toriyama, Omiya, both of Japan

[73] Assignee: Shinhokoku Steel Corporation, Tokyo, Japan

[21] Appl. No.: 532,768

[22] PCT Filed: Jan. 31, 1994

[86] PCT No.: PCT/JP94/00130

§ 371 Date: Sep. 27, 1995

§ 102(e) Date: Sep. 27, 1995

[87] PCT Pub. No.: WO95/20686

PCT Pub. Date: Aug. 3, 1995

[51] Int. Cl.[6] ..... C22C 38/38

[52] U.S. Cl. ..... 420/74

[58] Field of Search ..... 420/74, 75

[56] References Cited

U.S. PATENT DOCUMENTS 3,556,777 1/1971 Petry .
4,039,328 8/1977 Novomeisky et al. .

FOREIGN PATENT DOCUMENTS 0143873 3/1985 European Pat. Off. ..... 420/74
743476 12/1943 Germany .
2118969 11/1983 United Kingdom ..... 420/74

*Primary Examiner*—Deborah Yee
*Attorney, Agent, or Firm*—Frishauf, Holtz, Goodman, Langer & Chick, P.C.

[57] ABSTRACT

The abrasive resistant high manganese cast steel of the present invention has a high wear resistance and a high shock resistance, and contains 1.3–1.4 weight % of C, 0.05–0.20 weight % of Si, 14.0–15.0 weight % of Mn, 0.5–1.5 weight % of Cr, 0.3–0.8 weight % of V, 0.2–0.4 weight % of Ti, and 0.5–1.0 weight % of Mo, and a balance of Fe and inevitable impurities.

1 Claim, 2 Drawing Sheets

ABRASIVE RESISTANT HIGH MANGANESE CAST STEEL

TECHNICAL FIELD

The present invention relates to an abrasive resistant high manganese cast steel used for a knife of an ore-crusher, or shockresistant and wearresistant parts such as a caterpillar shoe for a conveying device, and the like.

BACKGROUND ART

A construction machine used for crushing various type of ores of mines, includes various types of parts such as a knife of a crusher, a caterpillar shoe for a conveying machine, a bucket knife, a rail and a rail point. The material for these parts is required to have not only a sufficient strength level as a structural member, but also an excellent abrasive resistance, a shock resistance and a corrosion resistance.

A high manganese cast steel, for example, Hadfield steel (carbon: 1–1.3 weight %, manganese: 11.5–13 wt %) has properties such as exhibiting an austenitic structure at room temperature, a low yield point, a high ultimate tensile strength, and a significant work hardening. Therefore, the hardness and the wear resistance of the steel can be increased by a cold working or surface abrasion. In general, a Hadfield steel is heated to 1050° C. or higher, and then quickly cooled, to make an abrasive resistant and shockresistant tough steel, a surface portion of which has a high hardness and an inside portion of which has a high toughness.

Jap. Pat. Appln. KOKAI Publications. Nos. 54-43818, 57-39158 and 55-53513, disclose an abrasive resistant high manganese cast steel in which crystal grains are refined by adding a small amount of each of the elements for preparing a carbide, such as Ti, V, Cu, Zr, Ce, Mo, W and Nb, and another abrasive resistant high manganese cast steel in which a small amount of spherical carbide is precipitated on the base material of a high carbon-manganese steel.

However, in the former abrasive resistant high manganese cast steel, it is difficult to remarkably improve the abrasive resistance only by fining the crystal grains, and the degree of the improvement is limited.

In the latter abrasive resistant high manganese cast steel, the wear resistance can be improved to a certain degree by enhancing the precipitation of the spherical carbide. However, the austenite matrix itself is not improved but maintained as it is, and therefore it is difficult to obtain a sufficient abrasive resistance while maintaining a required level in shock resistance.

The present invention has been proposed to solve the above-described problems and the object thereof is to provide an abrasive resistant high manganese cast steel having an excellent abrasive resistance and an excellent shock resistance.

DISCLOSURE OF INVENTION

According to the present invention, there is provided an abrasive resistant high manganese cast steel characterized by containing: 1.3–1.4 weight % of C, 0.05–0.20 weight % of Si, 14.0–15.0 weight % of Mn, 0.5–1.5 weight % of Cr, 0.3–0.8 weight % of V, 0.2–0.4 weight % of Ti, and 0.5–1.0 weight % of Mo, and a balance of Fe and inevitable impurities.

The reasons for specifying the ranges of the contents of the component elements will now be described one by one.

Regarding C, the content is determined in consideration of the balance between the carbide generating element amount and the Mn content. When the carbon content becomes lower than 1.3%, the carbide is not precipitated in an amount sufficient to reinforce the matrix, resulting in an insufficient wear resistance. In contrast, when the carbon content exceeds 1.4%, the carbide is generated by precipitation in an excessive amount, thus reducing the shock resistance. This is because the toughness of an alloy steel is generally improved as the content ratio of carbon with respect to that of Mn (Mn/C ratio) is increased.

Usually, Si is added to a high carbon and high manganese steel in an amount of 0.2–1.0 weight %. The purposes of the addition of Si are to refine the bath and improve the bath flow when casting. These purposes can be also achieved by using other means to refine the bath, which results in minimizing the amount of non-metal inclusions, and therefore an excessive addition of Si, which basically embrittles the austenite matrix, is not preferable. For this reason, the upper limit of the Si amount is set to 0.2%, in order to achieve the improvement of toughness as much as possible. The reason for setting the lower limit of the Si amount to 0.05%, is that Si enters inevitably from a scrap and can contribute to the refining effect as a deoxidizer even for a small degree. However, the function of Si as a deoxidizer can be achieved also by Al, and therefore the Si amount should preferably be as low as possible, to prevent an excessive deoxidization. The Si content should most preferably be in a range of 0.08 to 0.15%.

Mn is a main element for stabilizing the austenite matrix, and it is necessary to add it to make the Mn/C ratio equal to or higher than a predetermined value, for the purpose of improving the toughness. The necessary amount of Mn is determined in accordance with the carbon content. In order to achieve a good toughness, an Mn amount of 14% is necessary with respect to a carbon amount of 1.3%, and an Mn amount of 15% is necessary with respect to a carbon amount of 1.4%.

Cr serves to enhance the hardenability and improve the proof stress and abrasive resistance; however it decreases the toughness. The reason for setting the lower limit of the Cr amount to 0.5% is that a practical abrasive resistance cannot be obtained if the Cr amount lowers this limit. In contrast, the reason for setting the upper limit of the Cr amount at 1.5%, is that a practical shock resistance cannot be obtained of the Cr amount exceeds this limit.

V is a strong carbide generating element. With a small amount of addition of this element, the proof stress is improved, and the crystal grains are fined; therefore, this element contributes to the improvement of the abrasive resistance. With an excessive amount of addition of this element, however, the toughness is decreased. In order to balance between the abrasive resistance and the shock resistance, the lower limit of the V amount is set to 0.3%, and the upper limit is set to 0.8%.

In similar to Ti, V is a strong carbide generating element. With a small amount of addition of this element, the crystal grains are fined; therefore, this element contributes to the improvement of the abrasive resistance. With an excessive amount of addition of this element, however, the toughness is decreased. In order to balance between the abrasive resistance and the shock resistance, the lower limit of the V amount is set to 0.2%, and the upper limit is set to 0.4%.

Mo, with a small amount of addition, improves its yield point and raises the hardenability and the drawing resistance, without decreasing the toughness. The abrasive resistance is improved as the carbide is generated. Thus, Mo is an effective element for preventing the occurrence of a crack in a thick cast product. In order to have such an effect exhibited, it is necessary to increase the Mo amount to 0.5% or more. However, the effect of the addition of Mo is saturated at an amount of 1.0%, and therefore the upper limit is set to 1.0%.

BEST MODE TO CARRY OUT THE INVENTION

An embodiment of the present invention will now be described with reference to drawings and tables.

Table 1 shows an example of the composition for each one of Example 1 and Comparative Examples 1–4. As shown in Table 1, Comparative Example 2 does not contain molybdenum, and Comparative Example 4 does not contain vanadium.

Table 2 shows the results of the examination with regard to various mechanical characteristics, carried out for each one of the cast steels of Example 1 and Comparative Examples 1–4. The items of the mechanical characteristics examined are the ultimate tensile strength, the elongation, the reduction of area, the hardness and the value of impact energy. The hardness is expressed in a value of Brinell hardness. The value of impact energy was obtained by a 2 mmV-notch Charpy test.

As is clear from Table 2, the results of the Example 1 are superior than those of the Comparative Examples 1–4. In particular, the Example is superior in the hardness and the impact resistance of these characteristics.

Figure 1:
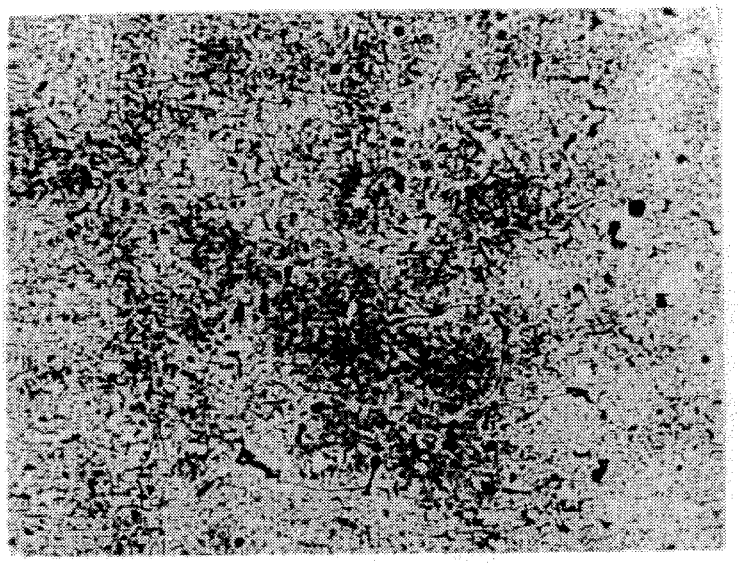
FIG. 1 is a photograph showing a metal structure (magnification: 200 times) of an abrasive resistance high manganese cast steel according to an embodiment of the present invention.

FIG. 1 (photograph) is a 200-times-magnified metal structure of a sample taken from the cast steel of Example 1. As is observed in this figure, granular or angular-shaped carbides are precipitated in crystal grains. Apart from these carbides having relatively large sizes, it is also observed that fine carbides are precipitated on the austenite base in its entire surface. These fine carbides are a mixture of vanadium carbides, titanium carbides, molybdenum carbides and chromium carbides, which are very hard and contribute to the improvement of the abrasive resistance without losing the necessary toughness.

Figure 2:
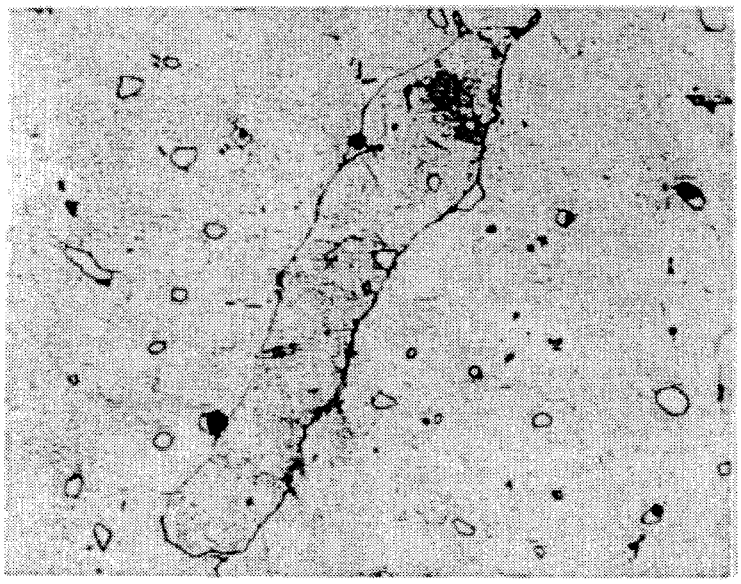
FIG. 2 is a photograph showing a metal structure (magnification: 200 times) of a conventional cast steel.

FIG. 2 (photograph 2) is a 200-times-magnified metal structure of a sample taken from the cast steel of Comparative Example 4. As can be observed, a small amount of spherical molybdenum carbides are dispersedly precipitated in crystal grains, yet the austenite matrix is as it has been.

Figure 3:
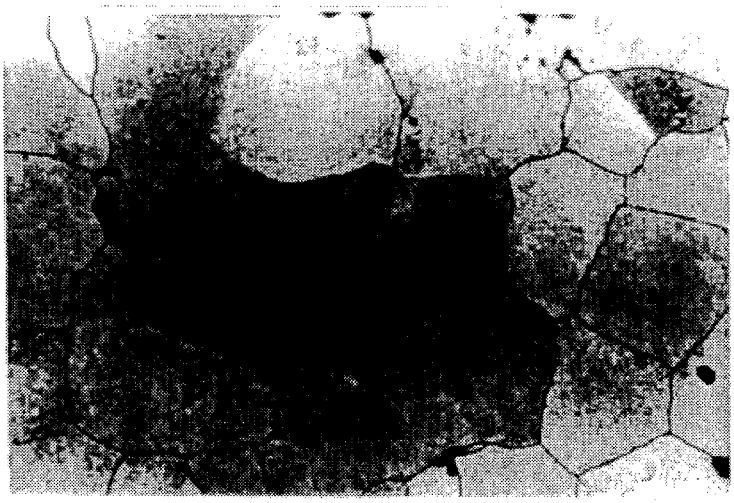
FIG. 3 is a photograph showing a metal structure (magnification: 200 times) of another conventional cast steel.

FIG. 3 (photograph 3) is a 200-times-magnified metal structure of a sample taken from the cast steel of Comparative Example 3. As can be observed, a small amount of spherical molybdenum carbides are dispersedly precipitated in crystal grains, yet the austenite matrix is as it has been.

The cast steel of the Example and those of the Comparative Example (Steel type: $G_{JS}S_{CMnH-11}$ of JIS standard) were used for an upper mantle of an ore crusher, and the lives of these types of steel were compared. It was confirmed with the result of the comparison that the life of the former was 1.43 times longer than that of the latter.

TABLE 1

| | Steel type | C | Si | Mn | Cr | V | Ti | Mo | P | S |
|---|---|---|---|---|---|---|---|---|---|---|
| Example 1 | A | 1.33 | 0.09 | 14.5 | 1.45 | 0.66 | 0.21 | 0.67 | 0.020 | 0.003 |
| Comparative Example 1 | B | 1.35 | 0.67 | 14.8 | 1.40 | 0.66 | 0.23 | 0.67 | 0.019 | 0.003 |
| Comparative Example 2 | C | 1.36 | 0.52 | 14.76 | 1.78 | 0.66 | 0.17 | — | 0.021 | 0.002 |
| Comparative Example 3 | D | 1.34 | 0.43 | 18.73 | 0.42 | 0.05 | 0.03 | 0.18 | 0.027 | 0.001 |
| Comparative Example 4 | E | 1.61 | 0.66 | 19.73 | 2.25 | — | 0.09 | 1.14 | 0.02 | 0.001 |

TABLE 2

| | Steel type | Tensil strength N/mm$^2$ | Elongation (%) | Reduction of area (%) | Hardness (HB) | Value of impact energy (kgf · m/cm$^2$) |
|---|---|---|---|---|---|---|
| Example 1 | A | 703.6 | 17.6 | 29.0 | 248 | 6.67 |
| Comparative Example 1 | B | 744.8 | 18.1 | 27.8 | 295 | 5.12 |
| Comparative Example 2 | C | 639.9 | 8.1 | 11.3 | 258 | 2.44 |
| Comparative Example 3 | D | 585 | 10.7 | 19.9 | 204 | 2.68 |
| Comparative Example 4 | E | 636 | 6.5 | 5.1 | 282 | 2.47 |

INDUSTRIAL APPLICABILITY

The cast steel of the present invention has a significantly improved abrasive resistance, as compared to the conventional steel. Therefore, the life of the various parts including the knife of an ore crusher, or the caterpillar shoe of a conveying machine can be remarkably prolonged.

We claim:

1. An abrasive resistant high manganese cast steel characterized by comprising: 1.3–1.4 weight % of C, 0.05–0.20 weight % of Si, 14.0–15.0 weight % of Mn, 0.5–1.5 weight % of Cr, 0.3–0.8 weight % of V, 0.2–0.4 weight % of Ti, and 0.5–1.0 weight % of Mo, and a balance of Fe and inevitable impurities.

* * * * *

UNITED STATES PATENT AND TRADEMARK OFFICE

CERTIFICATE OF CORRECTION

PATENT NO. : 5,601,782
DATED : February 11, 1997
INVENTOR(S) : KUNIOKA et al

It is certified that error appears in the above-identified patent and that said Letters Patent is hereby corrected as shown below:

Title Page, right column, under FOREIGN PATENT DOCUMENTS, insert

--61-44934 10/1986 Japan
62-8509 2/1987 Japan--.

Signed and Sealed this

Thirteenth Day of October 1998

*Attest:*

*Attesting Officer*

BRUCE LEHMAN

*Commissioner of Patents and Trademarks*